US006940474B2

(12) United States Patent
Weitbruch et al.

(10) Patent No.: US 6,940,474 B2
(45) Date of Patent: Sep. 6, 2005

(54) METHOD AND APPARATUS FOR PROCESSING VIDEO PICTURES

(75) Inventors: Sébastien Weitbruch, Mönchweller (DE); Cédric Thebault, Villingen (DE); Axel Goetzke, VS-Oberesohach (DE)

(73) Assignee: Thomson Licensing, Boulogne-Billancourt (FR)

( * ) Notice: Subject to any disclaimer, the term of this patent is extended or adjusted under 35 U.S.C. 154(b) by 232 days.

(21) Appl. No.: 10/340,146

(22) Filed: Jan. 10, 2003

(65) Prior Publication Data

US 2003/0137473 A1 Jul. 24, 2003

(30) Foreign Application Priority Data

Jan. 16, 2002 (EP) ..... 02000946

(51) Int. Cl.[7] ..... G09G 3/28

(52) U.S. Cl. ..... 345/60; 345/55; 345/62; 315/169.1; 315/169.2; 349/33

(58) Field of Search ..... 345/60, 55, 62, 345/66, 67, 691, 692, 693, 215, 33; 315/169.1, 169.2

(56) References Cited

U.S. PATENT DOCUMENTS 6,396,508 B1 * 5/2002 Noecker ..... 345/693
6,466,186 B1 * 10/2002 Shimizu et al. ..... 345/60
6,489,727 B2 * 12/2002 Kanazawa ..... 315/169.4
6,680,716 B2 * 1/2004 Nakamura ..... 345/60
6,734,844 B2 * 5/2004 Mizobata ..... 345/208

FOREIGN PATENT DOCUMENTS

WO WO0046782 8/2000
WO WO0156003 1/2002

OTHER PUBLICATIONS

EPO Search Report.

* cited by examiner

*Primary Examiner*—Xiao Wu
*Assistant Examiner*—Abbas I Abdulselam
(74) *Attorney, Agent, or Firm*—Joseph L. Laks; Harvey D. Fried; Patricia A. Verlangieri

(57) ABSTRACT

The present invention relates to a method for processing video signals for display on a display panel comprising a matrix array of cells which could only be "ON" or "OFF", wherein the time duration of a video field is divided into N sub-fields during which the cells can be activated, each sub-field comprising at least an addressing period and a sustaining period, the duration of which corresponding to the weight associated with said sub-field, said method comprising at least a priming period, characterized in that the position of the priming period is determined as follows:

determination of a sustain threshold value D for a given addressing speed and panel technology, calculation of the number of sustain pulses in each sub-field n, n being such that $1 \leqq n \leqq N$, if the number of sustain pulses is above or equal to D, addition of a priming pulse before at least the sub-field n+1.

This method is mainly applicable to plasma display panel.

6 Claims, 3 Drawing Sheets

(1)
(2)
(3)
(5)
(8)
(12)
(18)
(24)
(31)
(40)
(50)
(61)
P
SF12
SF11
SF10
SF1
Sustain number depending on picture content

METHOD AND APPARATUS FOR PROCESSING VIDEO PICTURES

The present invention relates to a method for processing video pictures, especially to a method for controlling priming pulses for improving the quality of pictures displayed on matrix display screens like plasma display panels (PDPs) or other display devices based on the principle of duty cycle modulation (PWM for Pulse Width Modulation) of light emission. The invention also relates to an apparatus for carrying out the method.

BACKGROUND OF THE INVENTION

The invention will be described in relation with PDP but may be applicable to other types of displays as mentioned above.

As well known, a plasma display panel is constituted by two insulating plates sealed together to form a space filled with gas. Ribs are provided inside the space to form a matrix array of discharge cells which could only be "ON" or "OFF". Also, unlike other displays such as CRT (Color ray tube) or LCD (Liquid Crystal Display) in which grey levels are expressed by analogue control of the light emission, a PDP controls the grey level by modulating the number of light pulses per frame. These light pulses are known as sustain pulses. The time-modulation will be integrated by the eye over a period corresponding to the eye time response.

To achieve a good picture quality, contrast is of paramount importance. However, on plasma display panels (PDPs), contrast values are inferior to those achieved for CRTs due, at least, to the following reasons:

In a PDP, it is common to use a certain amount of priming operations per frame of video picture. This priming process which makes a pre-excitation of the plasma cell is required to prepare the cells for homogeneous writing of each sub-period of the frame called "sub-fields". In known addressing modes, two types of priming pulses can be distinguished hard-priming pulses (square form pulses, with very fast increasing slope) which are used once per frame period and soft priming pulses (triangular form pulses, with slow increasing slope) which are presently used once per sub-field. Actually, the second type of priming is used in almost every panel type. The priming process has the negative effect that a panel background light is generated. The hard priming operation creates important background luminance which reduces achievable contrast factor. The soft priming operation is used for each sub-field. It creates less background luminance per operation, but because soft priming is in general used many times per frame, this will increase the background and the total result may be worse. The same problem will arise, if more sub-fields are used in each frame since the number of priming operations is commonly linked to the number of sub-fields.

In addition, the panel efficacy (lumen/watt) is limited, and for a given power consumption of the PDP, only a limited luminance can be performed on the screen depending on the picture content.

To overcome the drawback of reduced contrast, it has been proposed, in PCT patent application No. WO01/56003 in the name of THOMSON Licensing S. A., to increase contrast of a PDP by the use of "self-priming" and "refreshing sub-fields". Self priming sub-fields reduce or eliminate the need for priming, thus making dark areas darker, while refreshing sub-fields can be addressed faster. In practice, the number of refreshing sub-fields in a frame period is higher than the number of the self-priming sub-fields. Therefore, the total addressing time can be reduced with this new technique.

Faster addressing leaves more time for sustain pulses, thus allowing bright areas that are brighter. This is especially true for PDP monitors connected to 75 Hz multimedia sources, because in order to have an acceptable number of sub-fields, picture power is normally limited for 75 Hz sources. In 50 Hz and 60 Hz modes, where picture power is normally limited by the power electronics, a reduced addressing time may be alternatively used for increasing the number of sub-fields and thus improving picture quality.

In fact, the concept described in the above PCT patent application works well in case of full-white pictures having a limited maximal white value (for example 100 cd/m$^2$ with around 150 sustain pulses). In that case, since the soft-priming light emission is below 0,1 cd/m$^2$, the contrast ratio is beyond 1000:1 in dark room. Nevertheless, experiments have shown that, when the number of sustain pulses grows, the biggest sub-fields will suffer from response fidelity problems. There are many reasons for that. For example:

The sub-fields are far away from the priming pulse located at the beginning of the frame and therefore more sensitive to response fidelity problems.

Such sub-fields contain more energy, which also generate more heating of the cell. Since the response fidelity problem increases with the temperature, such sub-fields generate more problems during an increasing of the overall luminance.

In addition, when the number of sustain pulses of a given sub-field increases too much, its inertia increases at the same time and response fidelity problems are encountered.

SUMMARY OF THE INVENTION

The object of the invention is to propose a new priming concept which increases the contrast ratio and decreases response fidelity problems.

The object of the invention is also to propose a new priming concept which can be used with the process described in PCT patent application No WO01/56003.

The present invention relates to a method for processing video signals for display on a display panel comprising a matrix array of cells which could only be "ON" or "OFF", wherein the time duration of a video field is divided into N sub-fields during which the cells can be activated, each sub-field comprising at least an addressing period and a sustaining period, the duration of which corresponding to the weight associated with said sub-field, said method comprising at least a priming period, characterized in that the position of the priming period is determined as follows:

- determination of a sustain threshold value D for a given addressing speed and for a given panel technology,
- calculation of the number of sustain pulses in each sub-field n, n being such that $1 \leqq n \leqq N$,
- if the number of sustain pulses is above or equal to D, addition of a priming pulse before at least the sub-field n+1.

According to a preferred embodiment, a priming pulse is added before all the sub-fields n+1 to N. With the features above, in case of "peak white" pictures, depending on the maximal luminance, more priming operations are used in order to perform a good response fidelity while keeping a maximal contrast ratio.

The above method may be improved by also adding a priming pulse at the beginning of the video field. Preferably, such priming operation is used in combination with an optimised coding such as a specific coding enabling to respect the Single-O-Level criterion in order to improve the panel response fidelity. This criterion allows only a maximum of one sub-field switched OFF between two sub-fields switched ON.

According to a specific embodiment, the determination of a sustain threshold value is done using a specific test pattern, modifying the sustain pulses number and determining for which sustain pulses number a response fidelity problem is visible, said number giving the sustain threshold value D.

The invention consists also in an apparatus for carrying out the above method. Said apparatus comprises a peak luminance enhancement (PLE) measuring unit, a sub-field coding unit and a plasma control unit. Said plasma control unit comprises at least an encoding look up table for storing various sub-field codes per PLE value, a selection of appropriate sustain table giving the sustain threshold value and priming table for PDP controlling.

DRAWINGS

The present invention will be explained hereafter in more detail with reference to the following description and the drawings wherein.

Figures 3A, 3B, 3C, 3D:
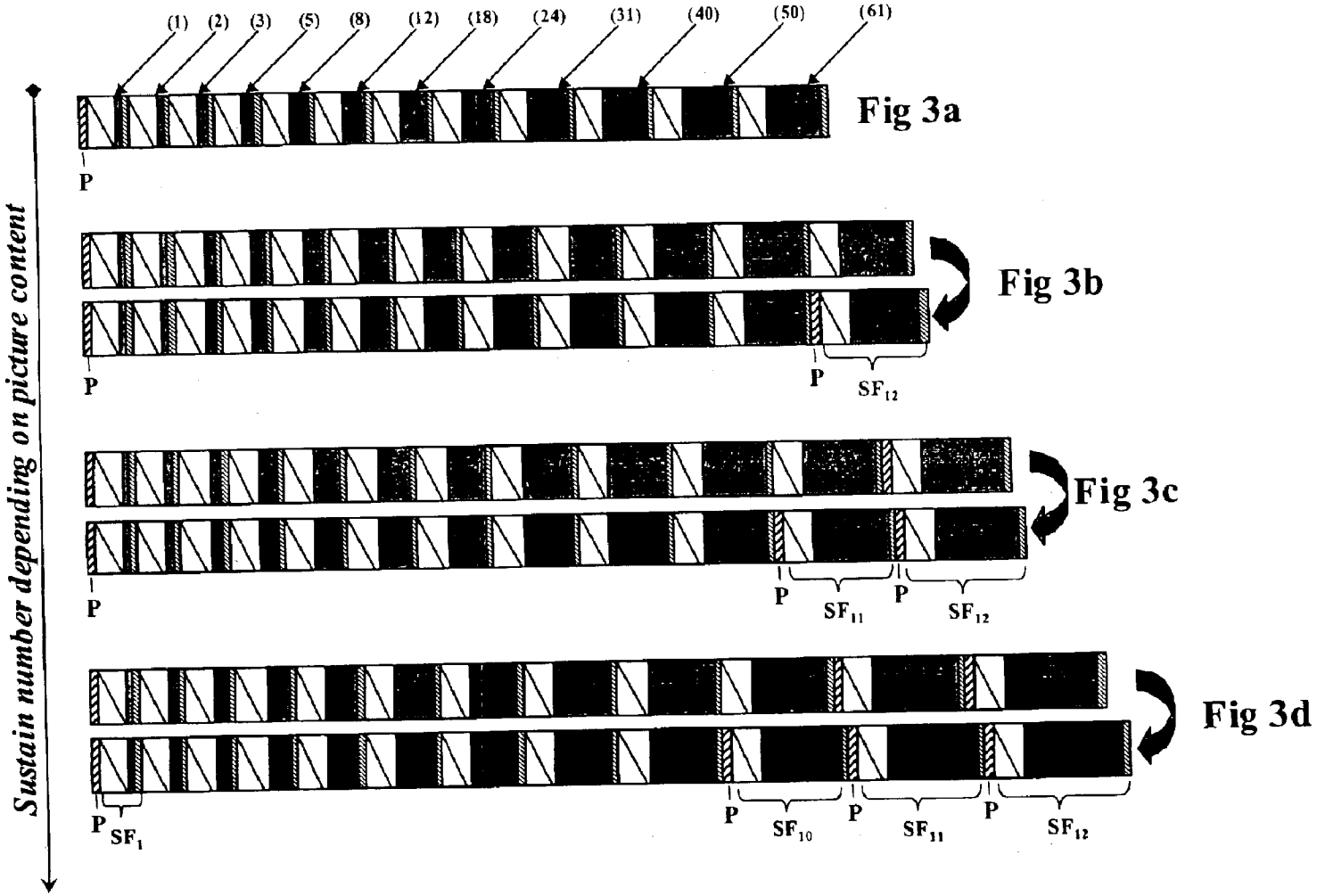
Figure 4:
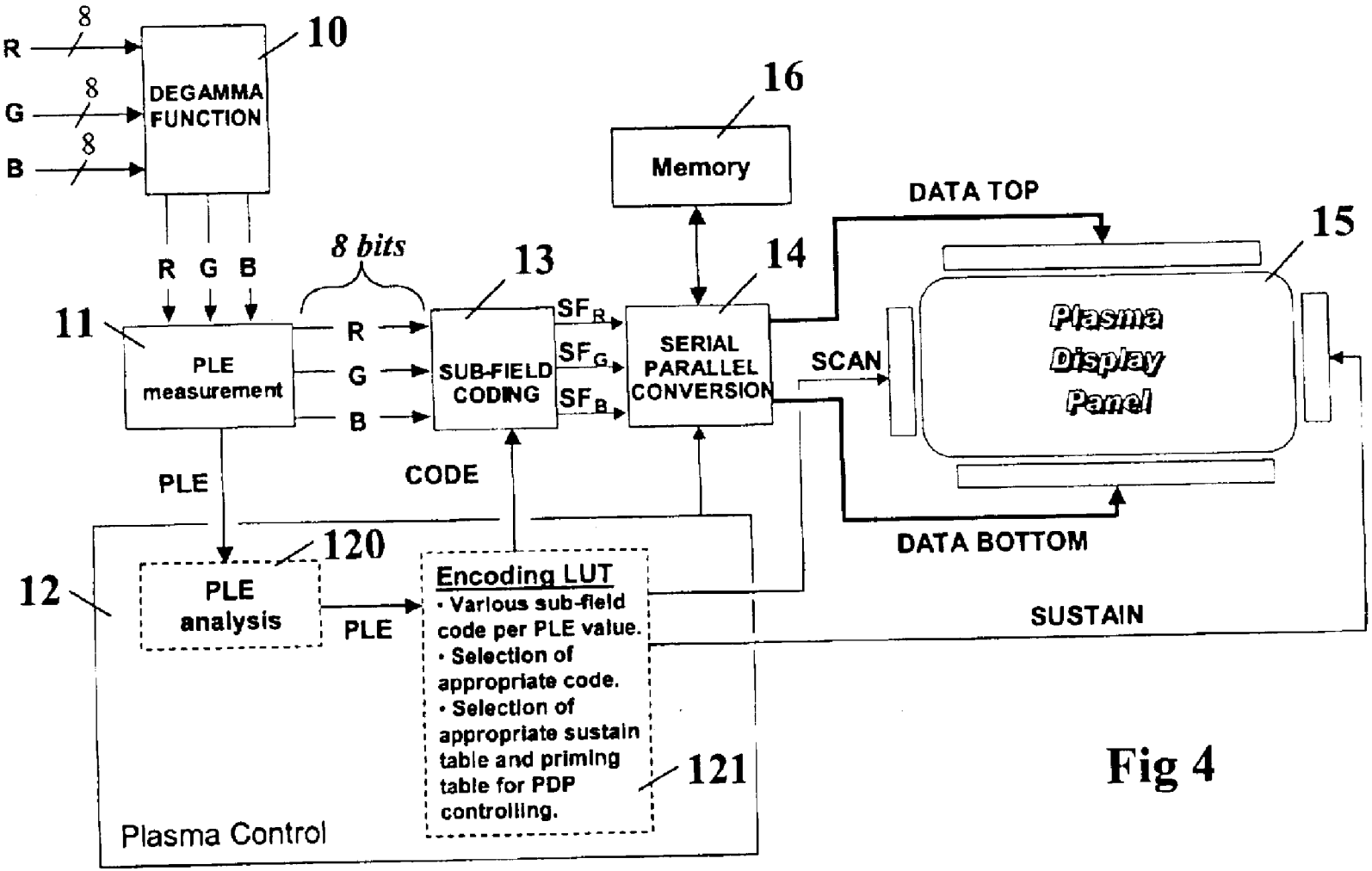

FIG. 3*a*–3*d* show examples of a sub-field organisation according to the present invention, and FIG. 4 shows schematically a block diagram of an apparatus according to the invention.

DESCRIPTION OF PREFERRED EMBODIMENTS

Figure 1:
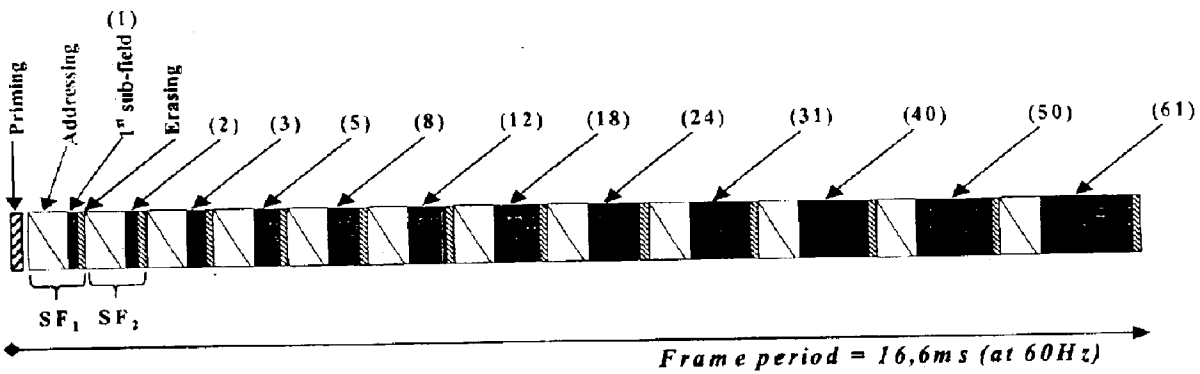
FIG. 1 shows an example of a sub-field organisation according to prior art.

On FIG. 1, a sub-field organisation with 12 sub-fields SF1 to SF12 is presented. The weights of the sub-fields are as follows:

1-2-3-5-8-12-18-24-31-40-50-61.

The specific weight in said sub-fields SFi($1 \leqq i \leqq 12$) represents a subdivision of the 256 video levels to be rendered in 8 bit video mode. Then each video level from 0 to 255 will be rendered by a combination of those sub-fields, each sub-field being either fully activated or deactivated. So, 256 video levels can be generated with this sub-field organisation as required in TV/video technology. FIG. 1 illustrates the frame period that is for example of 16,6 ms for 60 Hz frame period and its sub-division in sub-fields SF. Each sub-field SF is a period of time in which successively the following is being done with a cell.

1. There is an addressing period of fixed length in which the cell is either brought to an excited state with a high voltage or to a neutral state with lower voltage.
2. There is a sustain period depending of the sub-field weighting in which a gas discharge is made with short voltage pulses which lead to corresponding short lighting pulses. Of course only the cells previously excited will produce lighting pulses. There will not be a gas discharge in the cells in neutral state.
3. There is an erasing period of fixed length in which the charge of the cells is quenched.

In addition, in the specific sub-field organisation described above, a single soft priming P is used at the beginning of the frame period. Moreover, the weights of the sub-fields are based on the mathematical Fibonacci sequence as described in PCT patent application No. WO 01/56003. This optimised sub-fields encoding enables to have no more than one sub-field OFF between two sub-fields ON (SOL concept). In fact, under some circumstances, this type of sub-field organisation with a single soft priming is not enough to obtain, perfect response fidelity.

The method of the present invention also uses a power control method as described for example in WO00/46782 in the name of THOMSON Licensing S. A. This method generates more or less sustain pulses as a function of average picture power, i.e., it switches between different modes with different power levels. In fact, the sub-field organisation is variable in respect to a factor for the sub-field weights which is used to vary the amount of small pulses generated during each sub-field. More specifically, the sub-field weight factor determines how many sustain pulses are produced for the sub-fields, e.g. if this factor is *2, that means that the sub-field weight number is to be multiplied by two to achieve the number of sustain pulses which are generated during an active sub-field period. The factor is determined by dividing the total number of sustain pulses by 255 which corresponds to the coding of the video levels. The total number of sustain pulses depends on the measure of the Power Level Enhancement (PLE) or of the Average Power Level (APL) for a given picture. So, for a full white picture, the number of sustain pulses will be low and for a peak white picture, the number of sustain pulses is high for the same power consumption. An example of the number of sustain pulses for each weight in function of the factor is given in the following table. It corresponds to the sub-field weights described above.

TABLE

| Sub-field weight Sustain/Weight | 1 | 2 | 3 | 5 | 8 | 12 | 18 | 24 | 31 | 40 | 50 | 61 | SUM |
|---|---|---|---|---|---|---|---|---|---|---|---|---|---|
| 0.4 | 1 | 1 | 1 | 2 | 3 | 5 | 7 | 10 | 12 | 16 | 20 | 24 | 102 |
| 0.6 | 1 | 1 | 2 | 3 | 5 | 7 | 11 | 14 | 19 | 24 | 30 | 37 | 154 |
| 0.8 | 1 | 2 | 2 | 4 | 6 | 10 | 14 | 19 | 25 | 32 | 40 | 49 | 204 |
| 1 | 1 | 2 | 3 | 5 | 8 | 12 | 18 | 24 | 31 | 40 | 50 | 61 | 255 |
| 1.2 | 1 | 2 | 4 | 6 | 10 | 14 | 22 | 29 | 37 | 48 | 60 | 73 | 306 |
| 1.4 | 1 | 3 | 4 | 7 | 11 | 17 | 25 | 34 | 43 | 56 | 70 | 85 | 356 |
| 1.6 | 2 | 3 | 5 | 8 | 13 | 19 | 29 | 38 | 50 | 64 | 80 | 98 | 409 |
| 1.8 | 2 | 4 | 5 | 9 | 14 | 22 | 32 | 43 | 56 | 72 | 90 | 110 | 459 |
| 2 | 2 | 4 | 6 | 10 | 16 | 24 | 36 | 48 | 62 | 80 | 100 | 122 | 510 |
| 2.2 | 2 | 4 | 7 | 11 | 18 | 26 | 40 | 53 | 68 | 88 | 110 | 134 | 561 |
| 2.4 | 2 | 5 | 7 | 12 | 19 | 29 | 43 | 58 | 74 | 96 | 120 | 146 | 611 |
| 2.6 | 3 | 5 | 8 | 13 | 21 | 31 | 47 | 62 | 81 | 104 | 130 | 159 | 664 |

TABLE-continued

| Sub-field weight Sustain/Weight | 1 | 2 | 3 | 5 | 8 | 12 | 18 | 24 | 31 | 40 | 50 | 61 | SUM |
|---|---|---|---|---|---|---|---|---|---|---|---|---|---|
| 2.8 | 3 | 6 | 8 | 14 | 22 | 34 | 50 | 67 | 87 | 112 | 140 | 171 | 714 |
| 3 | 3 | 6 | 9 | 15 | 24 | 36 | 54 | 72 | 93 | 120 | 150 | 183 | 765 |
| 3.2 | 3 | 6 | 10 | 16 | 26 | 38 | 58 | 77 | 99 | 128 | 160 | 195 | 816 |
| 3.4 | 3 | 7 | 10 | 17 | 27 | 41 | 61 | 82 | 105 | 136 | 170 | 207 | 866 |
| 3.6 | 4 | 7 | 11 | 18 | 29 | 43 | 65 | 86 | 112 | 144 | 180 | 220 | 919 |
| 3.8 | 4 | 8 | 11 | 19 | 30 | 46 | 68 | 91 | 118 | 152 | 190 | 232 | 969 |
| 4 | 4 | 8 | 12 | 20 | 32 | 48 | 72 | 96 | 124 | 160 | 200 | 244 | 1020 |
| 4.2 | 4 | 8 | 13 | 21 | 34 | 50 | 76 | 101 | 130 | 168 | 210 | 256 | 1071 |
| 4.4 | 4 | 9 | 13 | 22 | 35 | 53 | 79 | 106 | 136 | 176 | 220 | 268 | 1121 |
| 4.6 | 5 | 9 | 14 | 23 | 37 | 55 | 83 | 110 | 143 | 184 | 230 | 281 | 1174 |
| 4.8 | 5 | 10 | 14 | 24 | 38 | 58 | 86 | 115 | 149 | 192 | 240 | 293 | 1224 |
| 5 | 5 | 10 | 15 | 25 | 40 | 60 | 90 | 120 | 155 | 200 | 250 | 305 | 1275 |
| 5.2 | 5 | 10 | 16 | 26 | 42 | 62 | 94 | 125 | 161 | 208 | 260 | 317 | 1326 |
| 5.4 | 5 | 11 | 16 | 27 | 43 | 65 | 97 | 130 | 167 | 216 | 270 | 329 | 1376 |
| 5.6 | 6 | 11 | 17 | 28 | 45 | 67 | 101 | 134 | 174 | 224 | 280 | 342 | 1429 |
| 5.8 | 6 | 12 | 17 | 29 | 46 | 70 | 104 | 139 | 180 | 232 | 290 | 354 | 1479 |
| 6 | 6 | 12 | 18 | 30 | 48 | 72 | 108 | 144 | 186 | 240 | 300 | 366 | 1530 |
| 6.2 | 6 | 12 | 19 | 31 | 50 | 74 | 112 | 149 | 192 | 248 | 310 | 378 | 1581 |
| 6.4 | 6 | 13 | 19 | 32 | 51 | 77 | 115 | 154 | 198 | 256 | 320 | 390 | 1631 |
| 6.6 | 7 | 13 | 20 | 33 | 53 | 79 | 119 | 158 | 205 | 264 | 330 | 403 | 1684 |
| 6.8 | 7 | 14 | 20 | 34 | 54 | 82 | 122 | 163 | 211 | 272 | 340 | 415 | 1734 |
| 7 | 7 | 14 | 21 | 35 | 56 | 84 | 126 | 168 | 217 | 280 | 350 | 427 | 1785 |
| 7.2 | 7 | 14 | 22 | 36 | 58 | 86 | 130 | 173 | 223 | 288 | 360 | 439 | 1836 |
| 7.4 | 7 | 15 | 22 | 37 | 59 | 89 | 133 | 178 | 229 | 296 | 370 | 451 | 1886 |
| 7.6 | 8 | 15 | 23 | 38 | 61 | 91 | 137 | 182 | 236 | 304 | 380 | 464 | 1939 |
| 7.8 | 8 | 16 | 23 | 39 | 62 | 94 | 140 | 187 | 242 | 312 | 390 | 476 | 1989 |
| 8 | 8 | 16 | 24 | 40 | 64 | 96 | 144 | 192 | 248 | 320 | 400 | 488 | 2040 |
| 8.2 | 8 | 16 | 25 | 41 | 66 | 98 | 148 | 197 | 254 | 328 | 410 | 500 | 2091 |

The method of the present invention will be described using the of sub-field organisation as described with reference to FIG. 1 the control method described above.

Figure 2:
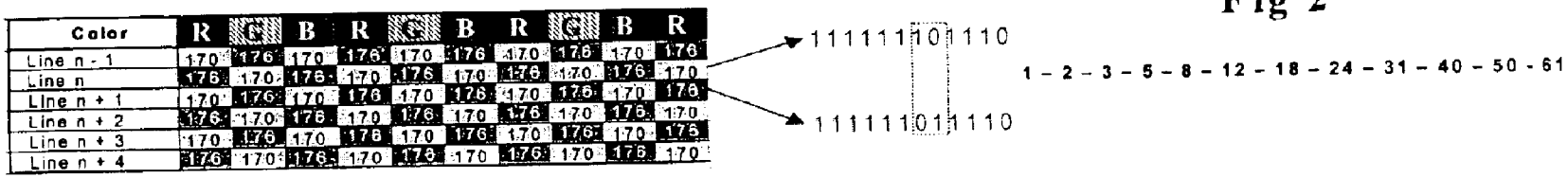
FIG. 2 shows a test pattern used to obtain the sustain threshold value.

First of all, to determine the sustain threshold value D, a specific test pattern is used as shown in FIG. 2. The specific test pattern has been built such that only two different grey levels are used, that two consecutive cells in a line receive sustain pulses corresponding to respectively one grey level and that the corresponding cells of two consecutive lines receive sustain pulses corresponding to respectively one grey level. In more detail, the two grey levels may be, for example, 170 and 176. How are chosen the value of these grey levels will be explained hereafter. In fact, these two grey levels 170 and 176 have respectively the corresponding digital code word 111111101110 and 111111011110. These two values have been chosen since they have something special together: indeed, all sub-fields are identical except the $7^{th}$ and $8^{th}$ ones. Therefore, they enable to illustrate the influence of the $7^{th}$ on the $8^{th}$. As explained above for line n−1, the value 170 is applied to the first red cell, the value 176 to the first green cell, the value 170 to the first blue cell, the value 176 to the second red cell, the value 170 to the second blue cell and so on.

For the line n, the value 176 is applied to the first red cell, the value 170 to the first green cell, the value 176 to the first blue cell and so on.

For the line n+1, the same schema, as for line n−1, is applied,

To determine the optimised picture, the control method described above is used. The sub-field weight factor is modified until a response fidelity problems on the border line of the screen appears. This problem is due to a different behaviour between border opened cells and inside closed cells. The number of sustain pulses obtained for the optimised factor is used to determine the sustain threshold value. For instance, let us assume that the first problem appears with a factor 4,4 at the transition between values 170 and 176: this means that the sub-field responsible for the miss-writing is the $7^{th}$ having a number of sustain equal to 79 (18×4,4), then the sustain threshold is set to 79. This value is stored in a specific table to be used afterward in the method according to the present invention. This value depends on the features of the PDP such as the chosen addressing speed and the panel technology (gas mixture, MgO layer, barrier ribs height, cell size . . . ).

Now, the present invention will be explained with reference to FIGS. 3*a*–3*d*. On FIGS. 3*a*–3*d*, the same coding of the sub-fields is used for the figures but different factors have been applied depending on the content of the picture.

FIG. 3*a* concerns a full white picture. In this case, the weights of the sub-fields are as follows:

1-2-3-5-8-12-18-24-31-40-50-61and the number of sustain pulses is 1-1-1-2-3-5-7-10-12-16-20-24as the sub-field weight factor is 0,4.

According to the present invention, the number of sustain pulses in each sub-field SF1 to SF12 is calculated and is compared to the sustain threshold value which is 79. As no number of sustain pulses is above 79, the priming sequence will be:

P=1-0-0-0-0-0-0-0-0-0-0-0-0.

In this specific case, only one single priming operation P is used at the beginning of the frame in combination with an optimised coding system. The contrast ratio is then maximal for such pictures having a limited maximal luminance for power consumption purposes.

FIGS. 3*b* to 3*d* represent the case of picture between full white picture and peak white picture. In FIG. 3*b*, the number of sustain pulses is increased so that the optimised sub-field weight factor is 1,6. In this case, for the same weights of sub-fields as above, the number of sustain pulses is:

2-3-5-8-13-19-29-38-50-64-80-98.

The number of sustain pulses of each sub-field SF1 to SF12 is compared to the sustain threshold value 79. It appears that for the sub-field SF11, the number of sustain pulses 80 is above the sustain threshold value. According to the present invention, a priming pulse P is added before the sub-field SF12.

In FIG. 3*c*, the number of sustain pulses is still increased to obtain a sub-field weight factor of 2. In this case, the number of sustain pulses is:

2-4-6-10-16-24-36-48-62-80-100-122.

After comparison of sub-field SF10 with the sustain threshold value 79, it appears that a priming pulse P has to be added on sub-field SF11. Moreover, another priming pulse P is also added on sub-field SF12, since the SF11 is also above the predetermined threshold as shown in FIG. 3*c*.

In the embodiments of FIGS. 3*b* and 3*c*, a first priming pulse P is also added at the beginning of the frame.

FIG. 3*d* represents the case where a priming P is also added on sub-field SF10 as well as on sub-fields SF11 and SF12. This case corresponds, for example, to a sub-field weight factor of 2,6 according to the above table.

The number of sustain pulses may be increased up to obtain a peak white picture. In this case, depending on the maximal luminance, more priming operations will be used in order to perform a good response fidelity while keeping a maximal contrast ratio. In the above table, the maximal number of priming to be added is 6 for a sub-field weight factor between 6,6 and 8,2.

The present invention has been described with reference to a mode based on 12 sub-fields. However, the present invention may be implemented in a PDP with several modes, for example, three modes based on 10, 11 and 12 sub-fields. In this case, the user can choose which modes he wants. For each mode, the PLE circuit will decide how many sustain pulses will be made in general. Nevertheless, with the same number of sustain pulses in total, the number of sustain pulses for each sub-field will change and also the number and the position of priming pulses.

So the present invention provides a type of dynamic priming system which is adapted to the maximal white luminance for having a good contrast ratio for all picture contents whatever are the power level modes.

In FIG. 4, a circuit implementation of the invention is illustrated. In the first block 10, the input video data R, G, B coded on 8-bit standard binary code is applied to a degamma function as well known in the art. Then, the video data RGB is applied to a PLE measurement circuit 11 where the RGB data is analysed and computed to give a PLE value sent to the plasma control block 12. The 8-bitvideo data is also sent to a sub-field coding circuit 13 that receives the appropriate code from a LUT table 121 in the plasma control block 12. Here to each normalised pixel value, a sub-field code word is assigned. The RGB sub-field data $SF_R$, $SF_G$, $SF_B$ are sent from the sub-field coding circuit 13 to the serial to parallel conversion circuit 14 and then to the column drivers (data top, data bottom) of the PDP 15.

As shown in FIG. 4, the plasma control circuit 12 comprises a PLE analysis circuit 120 that receives the PLE signal from PLE measurement circuit 11. This circuit 120 provides a filtering and a hysterisis control of the system.

Then the PLE value from the circuit 120 is sent to a LUT table 121 storing various data to realise the selection of appropriate code, the selection of appropriate sustain table and priming table as well as various sub-field code per PLE value as explained above.

Depending on the actual PLE value, a specific sub-field encoding table converting 8-bit video data in sub-field codeword is loaded in the block 13 to make the sub-field encoding. The serial to parallel conversion block 14 will load in a memory 16 the various sub-field separately (e.g. 12 different tables of 1 bit). Then during the frame the various sub-field data (1 bit) are send line per line to the data driver. Before sending a sub-field n, the corresponding priming table located in 121 is read to determine if a priming operation is required or not before sub-field n. After writing, the corresponding sustain table is read to send the required number of sustain to sustain generator.

The embodiment described above can be modified without departing from the scope of the claims. In particular other grey level values for the test pattern or other type of codings may be used.

What is claimed is:

1. A method for processing video signals for display on a display panel comprising a matrix array of cells which could only be "ON" or "OFF", wherein the time duration of a video frame is divided into N sub-fields during which the cells can be activated, each sub-field comprising at least an addressing period and a sustaining period, the duration of which corresponding to the weight associated with said sub-field, said method comprising at east a priming period for putting the cells in homogeneous states, with a position determined using the following steps:

determination of a sustain threshold value D for a given addressing speed and panel technology, calculation of the number of sustain pulses in each sub-field n, n being such that $1 \leqq n \leqq N$, and for at least one sub-field n with $n \leqq N-1$ and for which the number of sustain pulses is above or equal to D, addition of a priming period the beginning of the sub-field n+1.

2. A method according to claim 1, wherein for each sub-field n with $n \leqq N-1$ and for which the number of sustain pulses is above or equal to D, a priming period is added at the beginning of the subfields n+1.

3. A method according to claim 1, wherein priming period is added at the beginning of each frame.

4. A method according to claim 3, wherein the video value are coded with the sub-fields so that there is never more than one sub-field switched OFF between two sub-fields switched ON.

5. A method according to claim 1, wherein the determination of a sustain threshold value is done using a specific test pattern, modifying the sustain pulses number and determining for which sustain pulses number a response fidelity problem is visible, said number giving the sustain threshold value D.

6. An apparatus for carrying out the method according to claim 1, characterized in that it comprises a peal luminance enhancement (PLE measuring unit, a sub-field coding unit and a plasma control unit, said plasma control unit comprising at least an encoding look up table for storing various sub-field codes per PLE value giving the sustain threshold value, a selection of appropriate sustain table and priming table for POP controlling.

* * * * *